United States Patent [19]

Tolley

[11] 4,202,863

[45] May 13, 1980

[54] SEPARATION OF IRON METAL VALUES FROM TITANIUM METAL VALUES

[75] Inventor: William K. Tolley, Arlington Heights, Ill.

[73] Assignee: UOP Inc., Des Plaines, Ill.

[21] Appl. No.: 963,870

[22] Filed: Nov. 27, 1978

[51] Int. Cl.[2] ..... C01G 23/04

[52] U.S. Cl. ..... 423/82; 423/83; 423/85; 423/86; 75/114; 75/101 R

[58] Field of Search ..... 423/82, 83, 85, 86; 75/101 R, 114

[56] References Cited

U.S. PATENT DOCUMENTS

| | | | |
|---|---|---|---|
| 3,076,692 | 2/1963 | Ruter et al. | 423/85 |
| 3,236,596 | 2/1966 | Zerngilel | 423/83 |
| 3,597,189 | 8/1971 | Sinha et al | 75/101 R |
| 3,649,243 | 3/1972 | Williams et al. | 75/101 K |
| 3,677,740 | 7/1972 | Williams et al. | 75/114 |
| 3,751,556 | 8/1973 | Whitehead et al. | 75/114 |
| 3,825,419 | 7/1974 | Chen | 75/101 R |
| 3,859,077 | 1/1975 | Othmer | 75/1 T |
| 3,903,239 | 9/1975 | Berkovich | 75/101 R |
| 3,929,962 | 12/1975 | Shiah | 423/83 |
| 4,038,364 | 7/1977 | Lailach | 423/82 |

*Primary Examiner*—Herbert T. Carter

*Attorney, Agent, or Firm*—James R. Hoatson, Jr.; Raymond H. Nelson; William H. Page, II

[57] ABSTRACT

In a process for recovering titanium metal values from a titanium bearing source which also contains iron, the source is subjected to a reductive roast followed by a leach of the reduced source with hydrogen chloride. The suppression of the dissolution of titanium during the leaching step of the process will be effected by the addition of a phosphoric acid to the leaching solution.

7 Claims, No Drawings

SEPARATION OF IRON METAL VALUES FROM TITANIUM METAL VALUES

BACKGROUND OF THE INVENTION

Titanium in metallic form or as a compound is an important element in the chemical series. For example, titanium dioxide is utilized in paint pigments, in white rubbers and plastics, floor coverings, glassware and ceramics, painting inks, as an opacifying agent in papers, etc. The other titanium compounds are used in electronics, as fire retardants, waterproofing agents, etc. The metal may be used as such or in alloy form as structural material in aircraft, in jet engines, marine equipment, textile machinery, surgical instruments, orthopedic appliances, sporting equipment, food handling equipment, etc. Heretofore in recovering the titanium from titanium bearing sources such as ilmenite, rutile, etc., the titanium has been subjected to separation steps which involve the formation of titanium as a compound in a valence state of +4, such compounds usually involving titanium oxide. However, when attempting to separate titanium dioxide from impurities which are also contained in the ore such as iron, a substantial portion of the titanium is also removed.

Heretofore in the prior art various methods have been utilized to recover titanium values from titanium bearing sources. For example, in U.S. Pat. No. 3,236,596 an unroasted ilmenite ore is leached with hydrogen chloride at an elevated temperature. Following this, dissolved iron is reduced with iron or other reductants to precipitate ferrous chloride by saturating the liquor with hydrogen chloride gas. The hydrogen chloride is then extracted from the liquor by a vacuum distillation and the titanium is recovered by conventional means. Likewise, U.S. Pat. No. 3,825,419 reduces an ilmenite ore to produce ferrous oxides. The reduced ore is then leached for about 4 hours under a moderate pressure thereby dissolving the iron in the acid along with about 15% of the titanium. The iron is recovered as ferric oxide containing impurities in the spray roaster while the insoluble product which is primarily titanium dioxide but which contains all of the insoluble material such as silica, chromite, etc., present in the original ore is recovered. U.S. Pat. No. 3,859,077 also discloses a process for recovering titanium in which a titanium tetrahalide is mixed with iron oxide in slag or a titaniferous ore at an extremely high temperature of about 1000° C. to produce volatile impurity chlorides and titanium dioxide. A similar patent, U.S. Pat. No. 3,929,962, also reduces a titanium bearing ore at a high temperature to produce titanium sesquioxide which is in a form whereby it is easier to treat for a titanium-iron separation. Another prior art reference, U.S. Pat. No. 3,903,239 teaches a method for recovering titanium in which unroasted ilmenite is leached over a period of days at room temperature to recover about 80% of the titanium. Sulfur dioxide is added during the leaching to cause a precipitation of the ferrous chloride after which titanium dioxide is recovered by diluting and heating the solution.

As will hereinafter be set forth in greater detail, it is possible to effect a more thorough separation of iron and titanium whereby the loss of titanium will be greatly diminished with a concomitant recovery of a higher yield of the desired product.

This invention relates to a process for separating iron metal values from titanium metal values in which both metal values are contained in a metal bearing source. More specifically, the invention is concerned with an improvement in a process for recovering titanium from a titanium bearing source such as ilmenite whereby the loss of titanium during the recovery process will be minimized.

By utilizing the process hereinafter described in greater detail, it is possible to take advantage of several facets of the process whereby the desired yield will be obtained in a relatively purer state and be in a more economical manner. Several advantages of utilizing the process include the fact that the reactions are effected in a relatively short period of time, for example, the leaching of the titanium ore which has been subjected to a reductive roast can be effected during a period of from 0.25 to about 0.5 hours. In addition, another advantage which is present is that the reactions may, if so desired, be effected at atmospheric pressure, thus obviating the use of relatively expensive and complicated equipment. Other advantages which are also present in the present process include the possibility of using relatively low grade ores as the starting material, and the acid need not be diluted to precipitate titanium dioxide thus decreasing the demand for water.

It is therefore an object of this invention to provide an improved process for the separation of iron from titanium in a titanium recovery process.

A further object of this invention is to provide a hydrometallurgical process for obtaining high yields of titanium metal values in a relatively pure state.

In one aspect an embodiment of this invention resides in a process for the separation of iron metal values from titanium metal values in a metal bearing source which contains both metals, said process comprises the steps of subjecting said metal bearing source to a reductive roast, leaching the reduced metal bearing source at an elevated temperature with a leaching solution comprising a hydrogen chloride source and a phosphoric acid, separating the leach liquor to the ferrous chloride from undissolved titanium metal values, and recovering said titanium metal values.

A specific embodiment of this invention is found in a process for the separation of iron metal values from titanium metal values which comprises subjecting a metal bearing source to a reductive roast at a temperature in the range of from about 650° to about 1000° C., thereafter leaching the reduced source at a temperature in the range of from about ambient to about 105° C. with aqueous hydrochloric acid containing from about 1% to about 10% by volume of a phosphoric acid, separating the leached solution from the solids and recovering titanium values from said solids.

Other objects and embodiments will be found in the following further detailed description of the present invention.

As hereinbefore set forth, the present invention is concerned with an improvement in the process for obtaining titanium metal values from a titanium bearing source such as ores including ilmenite, rutile, etc. By utilizing the present process, it is possible to effect a better separation of the iron which is also present in the ore from the titanium thereby permitting a greater recovery of the desired product in a relatively purer state.

The process of obtaining the desired titanium metal values is effected by subjecting a titanium bearing source such as an ore which also contains other metals such as iron, vanadium, chromium, manganese, etc., to a reductive roast at an elevated temperature which will range from about 650° to about 1000° C. or more, said reductive roast being effected in the presence of a reducing gas such as hydrogen, carbon monoxide, a combination of carbon monoxide and hydrogen, etc., or any other suitable reducing means. In the preferred embodiment the reductive roast is effected on a metal bearing source such as an ore which has been crushed to a particle size less than about 35 mesh, said roast taking place during a period of time which may range from about 0.5 up to about 2 hours or more. One particularly effective reducing atmosphere which may be used to accomplish the purpose of the roast usually comprises a mixture of about 50% carbon monoxide and 50% hydrogen, with an excess of the reductant being utilized.

Following the reductive roast of the metal bearing source, such source is then subjected to a leach in order to effect a separation of the iron from the titanium. In the prior art this leach has been accomplished by utilizing a hydrogen chloride source such as aqueous hydrochloric acid to dissolve the iron and a considerable portion of the titanium which will be present in solution in the form of iron chloride and titanium chloride. The leach is usually effected at elevated temperatures usually in the range of from about 50° to about 105° C. for a period of time which may range from about 0.5 up to about 1 hour or more in duration. Generally speaking, the hydrogen chloride source usually comprises an aqueous hydrogen chloride solution which may also be characterized as hydrochloric acid and which will contain from about 20% up to about 37% hydrogen chloride. Subsequent to the completion of the leaching step of the operation, the resulting solution may be thereafter cooled to a temperature ranging from about 0° to about 50° C. in order to effect a crystallization or precipitation of some of the impurities such as ferrous chloride. After separating the crystallized ferrous chloride from the leach liquor, the spent solution may be treated for recycle. Alternatively, the leach solution may be treated at high temperature to produce iron oxide and regenerate the hydrogen chloride source. Another method of obtaining the desired titanium metal values consists in treating the reduced titanium source with a hydrogen chloride source to form a pregnant leach liquor containing soluble titanium trichloride which is treated with an iron oxide or other metal oxides with the metal present in its highest valence state, a specific example of this metal oxide being ferric oxide. This treatment will result in the formation of titanium dioxide and ferrous chloride, the titanium dioxide being in solid state may then be separated from the dissolved ferrous chloride and recovered.

It has been known in the art that in treating the ilmenite ore to selectively remove iron that substantial portions of the titanium which is present are also removed and lost in the solution or are recovered by a series of steps and involves a greater expense and more equipment. In contradistinction to this, I have now discovered that by utilizing a relatively minor amount of phosphoric acid in the aqueous hydrochloric acid leach solution, it is possible to suppress the dissolution of titanium during the leaching step of the process while still permitting the enhanced selectivity and rapid reaction rate which is possible for the selective removal of iron from the ore source. In the process of the present invention by adding from about 1% to about 10% by volume of a phosphoric acid such as pyrophosphoric acid, orthophosphoric acid, metaphosphoric acid, etc., to the lixiviant, it is possible to retain substantially all of the titanium which is present in the ore source in a solid state while permitting the iron which is present in the ore to form soluble compounds. Thus, the recovery of titanium will be greatly enhanced, greater yields of the desired product being obtained and thus permitting the process to be accomplished in a more inexpensive manner with a greater return of the desired product. The solid titanium metal values may be recovered as titanium dioxide or, if so desired, the titanium dioxide may be chlorinated in any manner known in the art to produce titanium tetrachloride which is also an important article of commerce.

The process of this invention may be effected in any suitable manner and may comprise either a batch or continuous type of operation. For example, when a batch type of operation is employed the ore after having been crushed to the desired particle size is then subjected to a reductive roast in an appropriate apparatus such as an oven while maintaining the temperature in a range of from about 650° to about 1000° C. while simultaneously passing a stream of reducing gas such as hydrogen, carbon monoxide, or a mixture of carbon monoxide and hydrogen over the ore. Following the reductive roast the metal bearing source is then placed in an appropriate apparatus wherein it is subjected to an aqueous hydrogen chloride leach, said leach solution containing a phosphoric acid in an amount within the range hereinbefore set forth. Following the leach which is effected at temperatures ranging from about ambient to about 105° C., preferably from about 80° to about 105° C., the leach liquor containing dissolved iron chloride is separated from the solids which comprise titanium, usually in the form of titanium dioxide due to the suppression of the dissolution of the titanium value with the concomitant formation of titanium chloride. After separation of the solids and leach liquor, the solids may then be treated in any manner required whereby the desired titanium metal values are recovered in the form of titanium dioxide or titanium tetrachloride. The subsequent treatment of the solid titanium metal values after separation from the dissolved iron chloride may include steps in which any other contaminants such as silicon, chromium, etc., are removed by conventional means thereby permitting the recovery of the titanium metal values in a greater yield and a purer state. The pregnant leach liquor containing dissolved ferrous chloride may then be cooled to a temperature in the range of from about 10° to about 30° C. by external cooling means thus permitting the crystallization of the iron. The recovered ferrous chloride crystals may then, if so desired, be treated by reduction with hydrogen at an elevated temperature to recover elemental iron or, if so desired, they may be oxidized in the presence of an oxygen-containing gas such as oxygen or air also at an elevated temperature to form ferric oxide.

It is also contemplated within the scope of this invention that the process may be effected in a continuous manner of operation. When this type of operation is employed the ore which has been previously crushed to the desired particle size is continuously fed to an oven which is maintained at the proper operating temperature and passed through said oven while being subjected to a reducing atmosphere such as hydrogen, carbon monoxide or a mixture of the two gases. After passage through the oven for a predetermined period of time, the reduced ore is continuously withdrawn and passed to a leaching vessel wherein it is contacted with an aqueous hydrogen chloride solution containing a specified amount of a phosphoric acid. After passage through said vessel for a predetermined period of time and while maintaining the vessel at a controlled temperature in the range hereinbefore set forth, the leach solution is continuously withdrawn and passed to a separator wherein the solids in said leach solution are separated from the leach liquor. The pregnant leach liquor is then passed to a cooling vessel, if so desired, for precipitation of ferrous chloride while the solids are passed to other purification steps and the desired titanium metal values recovered.

The following examples are given for the purposes of illustrating the improvement which constitutes the present invention. However, it is to be understood that these examples are given merely for purposes of illustration, and that the present invention is not necessarily limited thereto.

EXAMPLE I

A Canadian ilmenite ore was crushed and sized to −100 mesh Tyler. Following this, 100 grams of the sized ilmenite ore was then placed in a rotating quartz tube and heated to a temperature of 750° C. to an atmopshere of dry nitrogen. Upon reaching this roasting temperature, the ore was roasted for 1 hour under a stream of reducing gas consisting of 320 ml/min. of carbon monoxide and 320 ml/min. of hydrogen. At the end of the 1 hour period, the ore was cooled under a nitrogen stream until it had reached room temperature.

Thereafter 50 grams of the reduced ore was subjected to a leach solution by adding said ore to a leach solution comprising 220 ml of hydrochloric acid mixture with 80 ml of water. After addition of the ore the solution was heated to a temperature of 100° C. and allowed to leach for a period of 15 minutes. At the end of this time the leach liquor was separated from the solids by filtration. The recovered solution comprising 285 ml was analyzed and found to contain 52.5 g/l of iron and 33.0 g/l of titanium. It was thus shown that over 90% of the titanium which was present in the ore was dissolved in the leach solution thus negating any selective separation of the iron and titanium.

EXAMPLE II

In this example the other 50 grams of the reduced ilmenite ore which was treated according to the process set forth in the above example was subjected to a leach by adding said ore to 300 ml of a solution comprising 225 ml of hydrochloric acid, 10 ml of orthophosphoric acid and 65 ml of water. The solution was heated to a temperature of 100° C. and allowed to leach at this temperature for a period of 30 minutes. At the end of the 30 minute period the solution was filtered, the solids were washed and dried. Analysis of the solution disclosed that there was only 0.4 g/l of titanium with a high percentage of iron also being present.

It is therefore readily apparent from a comparison of the two examples that by utilizing a relatively minor amount of phosphoric acid in the hydrochloric acid leach solution it was possible to selectively dissolve the iron which is present in the ilmenite ore with only a small amount of titanium also being dissolved. By utilizing the presence of phosphoric acid, it is therefore possible to selectively separate iron from titanium with a concomitant minor loss of titanium.

I claim as my invention:

1. A process for the separation of iron metal values from titanium metal values in a metal bearing source selected from the group consisting of ilmenite and rutile which comprises:
   (a) treating said ilmenite or rutile to a reductive roast at a temperature of from about 650° C. to about 1000° C. in the presence of a reducing gas;
   (b) leaching said reduced ilmenite or rutile of step (a) at an elevated temperature of from about 50° C. to about 105° C. with a leaching solution comprising an aqueous hydrogen chloride solution containing from about 1 volume percent to about 10 volume percent of a phosphoric acid to form a leach liquid and undissolved titanium metal values;
   (c) separating said leach liquor from said undissolved titanium metal values; and
   (d) recovering said titanium metal values.

2. The process as set forth in claim 1 in which said phosphoric acid is pyrophosphoric acid.

3. The process as set forth in claim 1 in which said phosphoric acid is orthophosphoric acid.

4. The process as set forth in claim 1 in which said phosphoric acid is metaphosphoric acid.

5. The process as set forth in claim 1 in which said leach is effected at a temperature in the range of from about 80° to about 105° C.

6. The process as set forth in claim 1 in which said titanium metal values are recovered as titanium dioxide.

7. The process as set forth in claim 1 in which said titanium metal values are subjected to chlorination and recovered as titanium tetrachloride.

* * * * *